United States Patent [19]

Albright et al.

[11] Patent Number: 4,757,915

[45] Date of Patent: Jul. 19, 1988

[54] VENDING MACHINE SHELF ASSEMBLY

[75] Inventors: Henry J. Albright, West Des Moines; Paul L. Hawkins; Randy E. Harwood, both of Guthrie Center, all of Iowa

[73] Assignee: Fawn Engineering Corp., Des Moines, Iowa

[21] Appl. No.: 899,651

[22] Filed: Aug. 25, 1986

[51] Int. Cl.[4] ..... G07F 11/36

[52] U.S. Cl. ..... 221/75; 221/242; 312/138 R; 312/215

[58] Field of Search ..... 221/75, 76, 123, 124, 221/129, 130, 133, 191, 194, 195, 241, 242, 281; 222/410, 413; 312/35, 138 R, 215, 273, 274, 311, 323, 333, 218, 220; 211/59.2, 59.3, 126

[56] References Cited

U.S. PATENT DOCUMENTS

| | | | |
|---|---|---|---|
| 2,300,956 | 11/1942 | Mergens | 221/75 |
| 3,085,711 | 4/1963 | Holstein et al. | 221/75 |
| 3,178,055 | 4/1965 | Schuller | 221/75 |
| 3,269,595 | 8/1966 | Krakauer et al. | 221/75 |
| 3,294,281 | 12/1966 | Schlaf | 221/75 X |
| 3,344,953 | 10/1967 | Krakauer et al. | 221/75 |
| 3,441,174 | 4/1969 | Kenney | 221/75 |
| 3,591,045 | 7/1971 | Sturrock | 221/75 |
| 3,601,281 | 8/1971 | Schlaf | 221/75 |
| 3,653,540 | 4/1972 | Offutt | 221/75 |
| 3,737,071 | 6/1973 | Offutt et al. | 221/129 |
| 3,990,754 | 11/1976 | Pitel et al. | 312/223 X |
| 3,993,215 | 11/1976 | Cox et al. | 221/75 |
| 4,023,704 | 5/1977 | Pitel et al. | 221/129 X |
| 4,046,440 | 9/1977 | Cox et al. | 312/35 X |
| 4,061,245 | 12/1977 | Lotspeich | 221/75 |
| 4,240,563 | 12/1980 | Lennartson | 221/75 |
| 4,280,745 | 7/1981 | Mitchell | 221/75 X |
| 4,506,802 | 3/1985 | Lotspeich | 221/75 |

*Primary Examiner*—Joseph J. Rolla
*Assistant Examiner*—Edward S. Ammeen
*Attorney, Agent, or Firm*—Henderson & Sturm

[57] ABSTRACT

Dispensing shelves for cabinet-type vending machines having a plurality of different sized helical feeder coils all on the same level for advancing articles interposed between the convolutions of the coils to a delivery opening. The width of the troughs holding the coils is variable on the same shelf level and the placement of the helical feeder coil within a trough is variable. The shelf is of either a sheet metal or a molded, high-density plastic type material. Drive units for the helical coils are removably mounted for operation without fastening devices and are adjustably laterally mounted within a single trough. A unique shelf support rail unit maintains the shelf side panels of the vending machine against lateral movement and bending. Further, a unique door closure member maintains the shelves in their vending positions at all times when the door is closed.

9 Claims, 8 Drawing Sheets

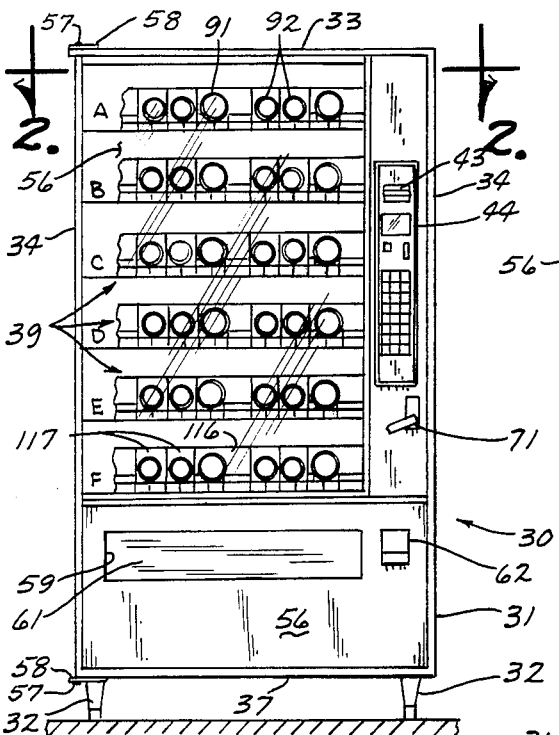
12. 9. Fig. 1
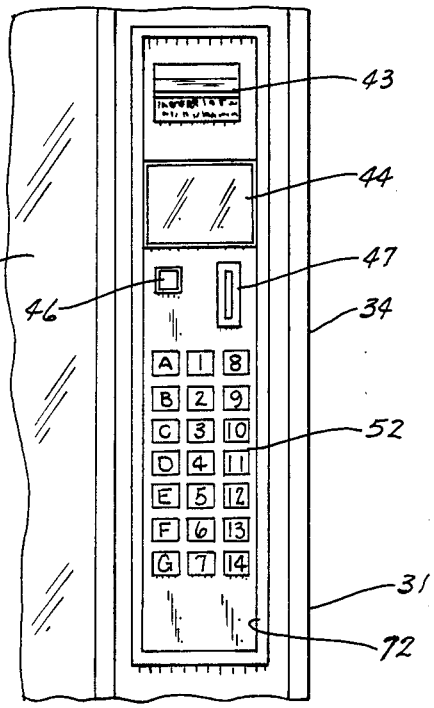
Fig. 3
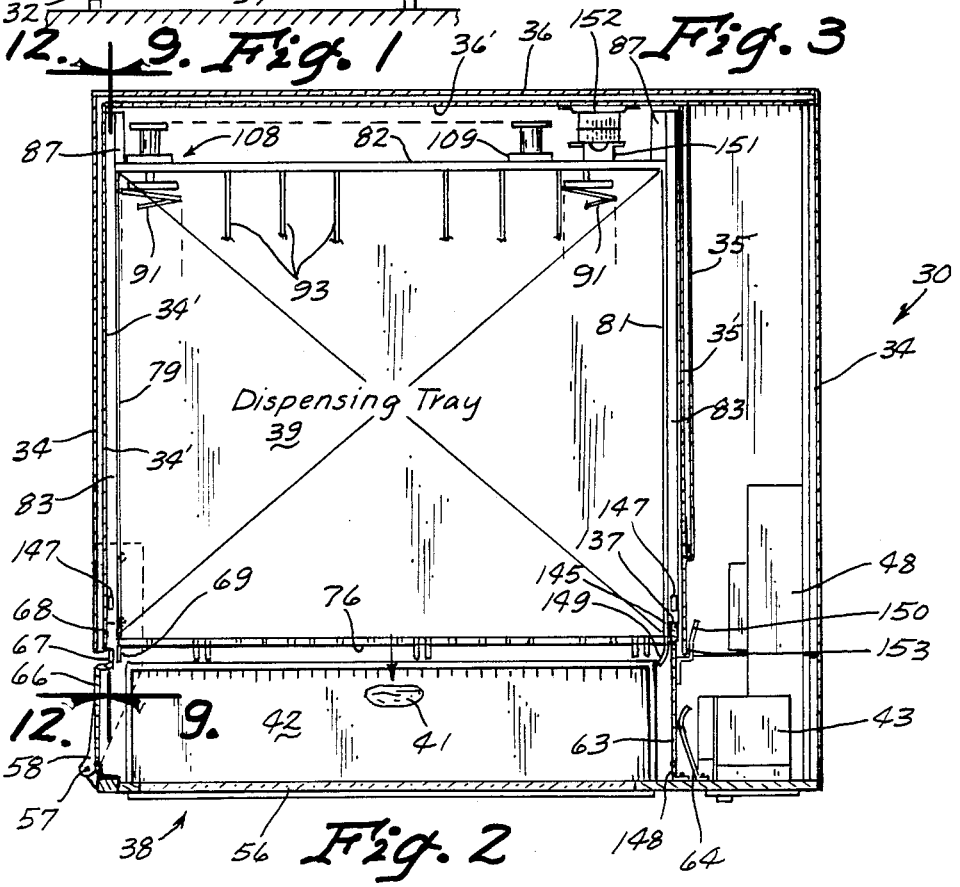
Fig. 2

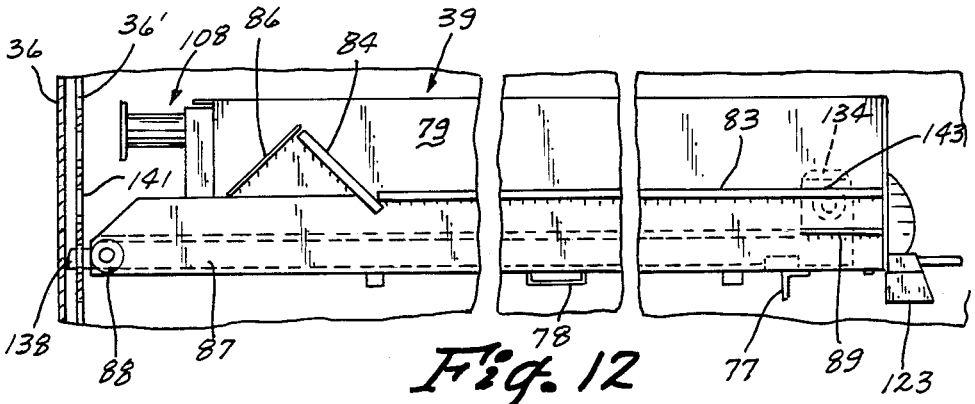
Fig. 12
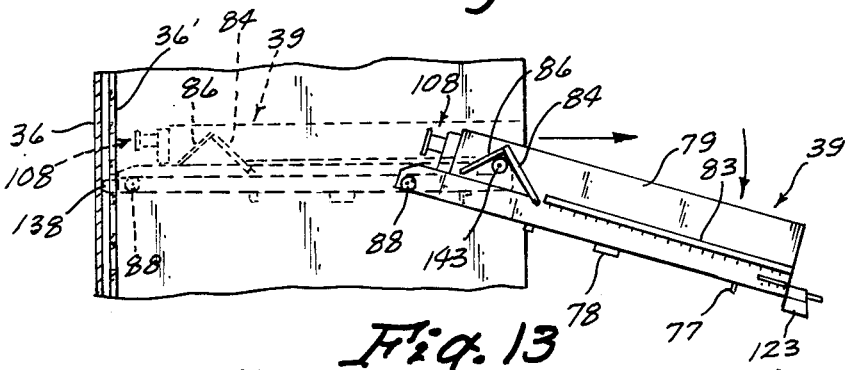
Fig. 13
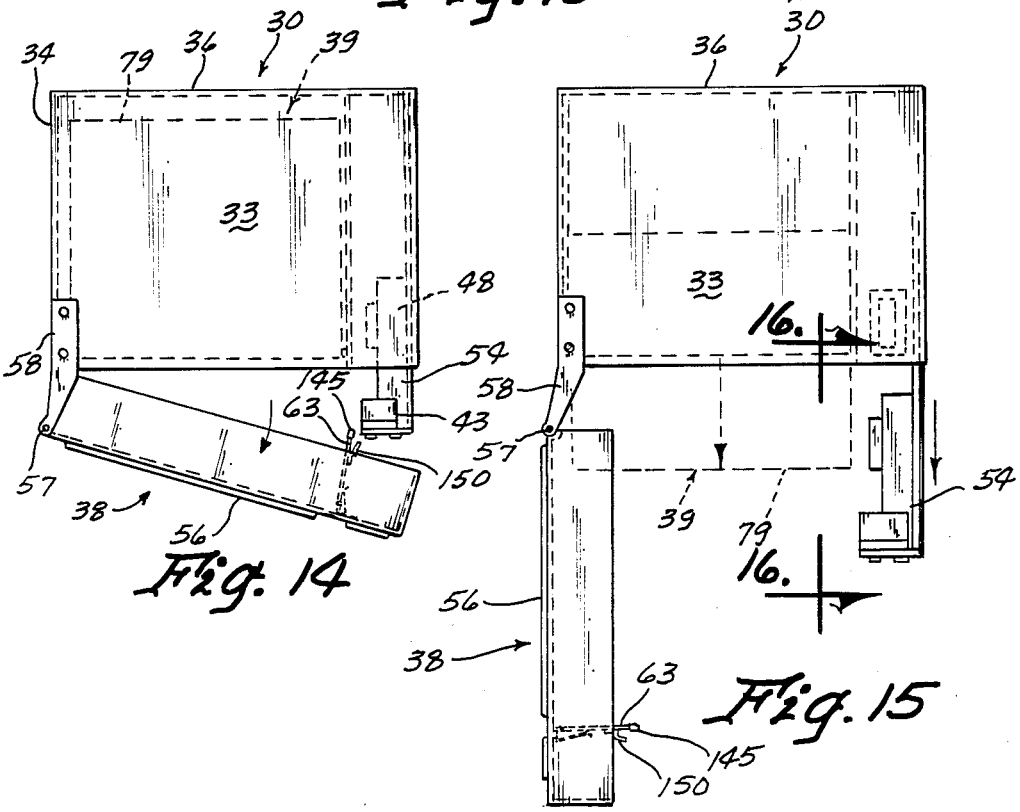
Fig. 14
Fig. 15

VENDING MACHINE SHELF ASSEMBLY

TECHNICAL FIELD

The present invention relates generally to an article vending machine, and more particularly to an improved shelf or tray assembly for use therein.

BACKGROUND ART

The present invention relates to article vending machines wherein a plurality of vertically stacked, generally horizontally disposed and movable trays are provided for holding a plurality of articles to be vended thereon. Each shelf usually has a plurality of front-to-rear generally rectangular spaces or troughs spaced laterally across the shelf and with a helical coil mounted in each trough. Articles to be vended are positioned within convolutions of the coil such that, upon the rotation of a particular coil in response to actuation of a control mechanism, one of the articles is projected into a delivery opening where it is available to a purchaser.

Shelves of this type are normally of a lightweight sheet metal construction wherein, once assembled, the troughs, helices, drive units and associated parts are secured in place as by conventional fastening devices not being removable except for servicing and repair purposes. The size of the helices and of the troughs within each shelf are the same, although they may vary between shelves for accommodating different sized products within the same machine. The drive units for the helices each have a single predetermined mounting location at the rear of the shelf.

Further, shelves of this type are usually slidably mounted on rollers or the like secured to the inner sides of the vending machine frame, for generally horizontal movement from an inner position for vending purposes to an outer exposed position for article loading and/or servicing purposes. During use of the shelves, they are not retained or captivated laterally by the sides of the machine frame or housing. To retain the shelves in place, lugs are formed on support rails mounted on the inner walls of the machine casing which counteract with side rails or the shelf.

DISCLOSURE OF THE INVENTION

The invention relates to an improved shelf arrangement for a vending machine wherein the shelf arrangement comprises at least one shelf movably mounted within the machine casing for movement between a vending position and a service or loading position, a first helix unit mounted on the shelf for dispensing one size of product from the shelf, a second helix unit mounted parallel to the first helix for dispensing a second product having a different size than the first product, and a divider which is adjustably mounted to the shelf between the first and second helices. Such adjustable mounting provides for lateral movement of the dividers on the shelf, thereby enabling the dispensing of different sizes of products by different sizes of helices, all on the same shelf.

The invention relates further to a shelf captivation arrangement wherein by the provision of a unique shelf support rail tied in with a shelf side rail, the support rail secured to the inner sides of the casing walls, the casing walls are structurally tied together at all times through the shelves for structural stability. Additionally, the shelf captivation system utilizes the weight of the shelf to lock the shelves in place for vending purposes, and a horizontal outward pull of each shelf results in a downwardly disposed shelf position for easy product replacement. Locking of the shelves in place for vending purposes is then provided by a door-mounted plate which engages each shelf upon the door being closed. This arrangement provides for self-locking of the shelves and also ensures electrical power to the drive units for each shelf by a shelf-to-rear casing wall electrical connection being securely coupled.

A modification of the invention provides a molded tray with laterally movable dividers and with a vertically removable drive unit support at the rear of each shelf, whereby a drive unit may be quickly and easily shifted laterally within the space for a single trough so as to shift the helix or to change the size of the helix, all within a single trough. Thus, helices of different sizes and products of different shapes may all be provided on one shelf with many variations thereof quickly obtained with a minimum of effort.

Importantly, whereas the prior art provides for the vending of one type of product—bag, for example, on a certain shelf, with the convertibility capabilities of this improved shelf arrangement, various and different products as to types, sizes, and wrappers—bag and candy, for example, can be vended on the same shelf; further, with a trough being readily converted as to width and size thereof, and as to the placement therein of different sizes of helical feeder coils, and even as to the location of a coil within the trough, all capable of being accomplished by the operator without removing the shelf from the vending machine.

It is an object of this invention to provide an improved shelf arrangement for a vending machine.

It is another object of this invention to provide a vending machine shelf wherein troughs of varied sizes are readily, adjustably formed thereon.

It is still another object of this invention to provide a vending machine shelf wherein helixes of varied sizes are readily, adjustably placed thereon.

Another object of this invention is to provide a vending machine shelf wherein helix drive units are adjustably moved to different mounting locations within a single trough, without the need of fastening devices.

It is yet another object of this invention to provide a vending machine shelf wherein the sides of the machine casing for the shelf are held together at all times by the rail captivation structure for each shelf.

Another object of this invention is to provide a vending machine shelf wherein the weight of the shelf is utilized to aid in locking it in place for vending purposes.

Yet another object of this invention is to provide a vending machine shelf wherein automatic locking and electrical coupling of the shelf is provided upon closing the machine door.

Still another object of this invention is wherein the shelf is comprised mainly of a molded material for economy of manufacture and reduction of weight.

BRIEF DESCRIPTION OF THE DRAWINGS

These and other objectives of the invention will become readily apparent upon a thorough study and review of the following detailed description of the preferred embodiment for carrying out the invention, particularly when viewed in conjunction with the accompanying drawings, wherein:

FIG. 1 is a front elevational view of a vending machine embodying the present invention;

FIG. 2 is an enlarged horizontal cross-sectional view taken along the line 2—2 in FIG. 1;

FIG. 3 is an enlarged front elevational view of the control panel of the vending machine;

FIG. 12 is a foreshortened, elevational view taken along the line 12—12 in FIG. 2;

FIG. 13 is an elevational view of a shelf unit shown in its extended loading position;

FIG. 14 is a plan view of the machine with the door partially opened;

FIG. 15 is a view similar to FIG. 14 and with the door open sufficiently for a shelf withdrawal, and showing an extended position of the control equipment for the machine;

BEST MODE FOR CARRYING OUT THE INVENTION

Figure 4:
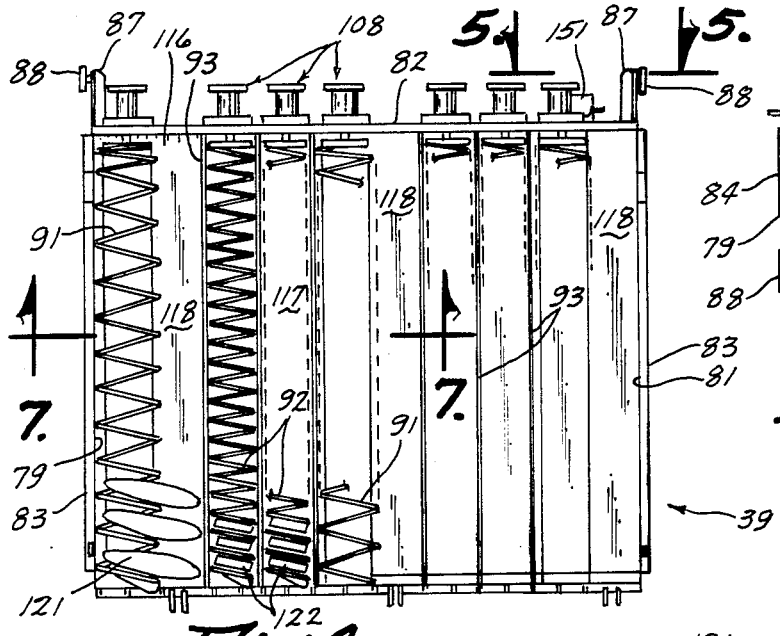
FIG. 4 is an enlarged plan view of a shelf structure with certain helixes in place.
Figure 5:
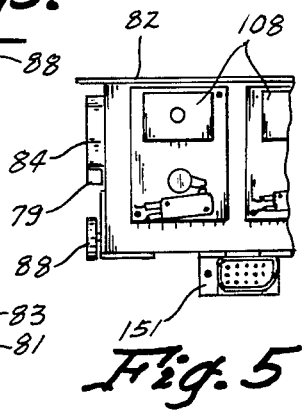
FIG. 5 is a fragmentary elevational view of the rear of one end of a shelf structure.

Referring now to the drawings, and particularly FIGS. 1-3 inclusive, the automatic vending machine of this invention is shown indicated generally at (30) and includes a box-like housing or casing (31). The casing (31) is mounted on legs or rollers (32) and includes a top (33), sidewalls (34), rear wall (36), bottom (37) and a hinged door (38). Within the casing (31) are mounted a plurality of shelves each indicated generally at (39), which shelves carry products (41) for discharge into a delivery drawer (42) and which are vertically spaced and horizontally slidable between an inner vending position (FIG. 2) and an extended position (FIG. 13) for servicing and loading purposes.

Figure 16:
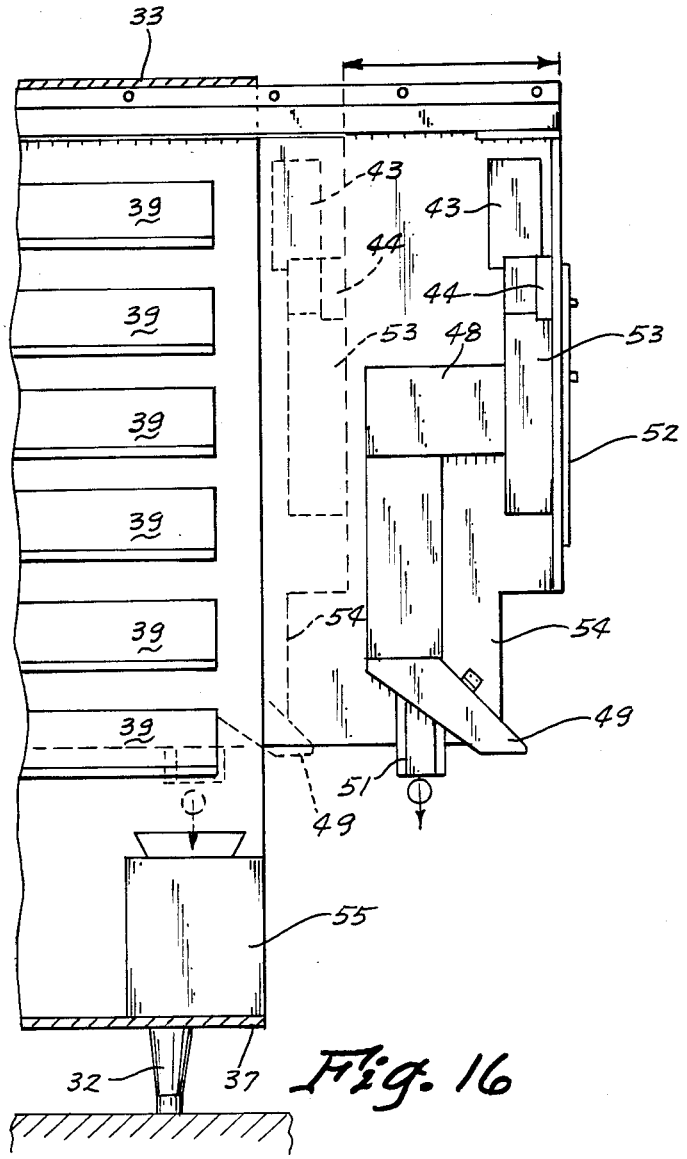
FIG. 16 is an elevational view of an inner wall of the machine showing the control equipment in its extended position.
Figure 17:
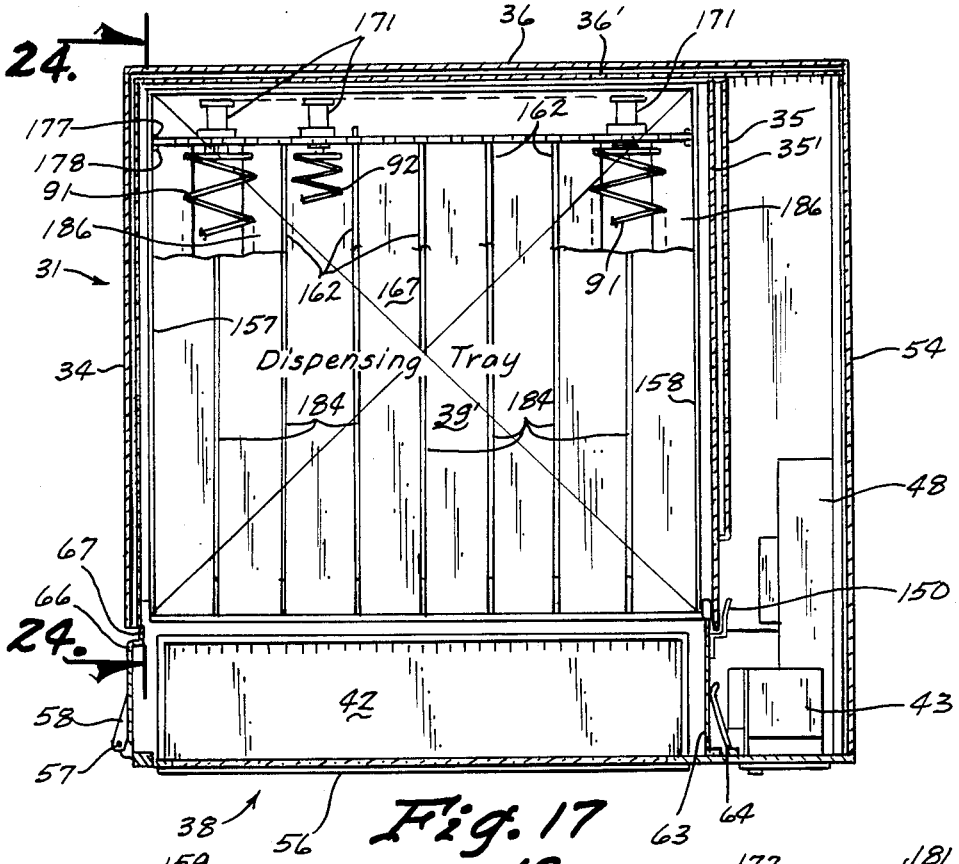
FIG. 17 is a view similar to FIG. 2, and showing a modified shelf unit in place in the vending machine.

The interior of the casing (31) carries further a grouping of control equipment including a dollar bill validator (43), a light emitting diode unit (44) for read-out information, a coin return switch (46), coin insert (47) (FIG. 3) for conventional coin mechanism (48) (FIG. 16) which mechanism includes a coin return chute (49), coin collector chute (51) and a membrane switch product selector panel (52) and combined microprocessor unit (53) (FIG. 16) for electronically selecting the particular product (41) (FIG. 2) to be vended. The control equipment is mounted on a vertically disposed side element (54) (FIG. 2) which is slidably connected to the adjacent sidewall (34) whereby the entire grouping of control equipment as described can be slid outwardly from an inner position as shown by dotted lines in FIG. 16, to an outer servicing position as shown in full lines in FIG. 16. A coin collector (55) is mounted on the casing floor (37) below the chute (51) to receive coins.

The door (38) has a transparent window (56) for viewing the shelves (39) and various products carried thereby, and is hingedly connected by pins (57) to upper and lower hinge plates (58) secured to the top and bottom walls (33, 37) of the casing (31). A delivery opening (59) is provided in the door (38) with a conventional anti-theft transparent delivery door (61) provided for the user to retrieve the product (41) from the drawer (42), the latter connected to the door (38). A coin return unit (62) is also provided as a part of the door (38).

The hinged door (38) includes further, a flexible shelf-closure member (63) (FIGS. 2 and 14), held by a support (64) and discussed further hereinafter, and a flexible end plate (66) an inner edge (67) of which is enclosed between an outer edge (68) of an inner sidewall (34') mounted parallel the outer sidewall (34), and a flange (69) secured to the interior of the casing (31). The function of the end plate (66) is described in our companion application entitled "Vending Machine Door Closure Mechanism" Ser. No. 06/900,180 assigned to a common assignee. A door handle (71) is provided for locking and unlatching the door (38). To view the faces of the control equipment as described hereinbefore, a rectangular opening (72) (FIG. 3) is formed in the door (38) which opening matches and mates with the control equipment face grouping as seen in FIGS. 1 and 3.

Referring particularly to FIGS. 2-8, one of the shelves (39) is illustrated with all six shelves (39) shown in FIG. 1 being the same, except for the alternate arrangement on each shelf (39) of the widths of troughs and the sizes of helixes now described. The shelves (39) are supported on and between the casing inner walls (34') and (35') (FIG. 2).

Each shelf (39) comprises a flat base (74) of sheet metal, for example, having a front depending lip (76), and including a transverse flange (77) (FIG. 13) and a transverse brace (78) both secured across the bottom of the base (74) in longitudinally spaced relation. Integral with the base (74) are a pair of upstanding side panels (79) and (81) and a rear panel (82). Along each outside of each side panel is a front inverted L-shaped runner (83) joined at its rear by a pair of L-shaped runners (84, 86) formed in an inverted V. At the rear end of each side panel (79, 81) an extension (87) is formed (FIG. 12) which has a roller (88) secured to its outer face. At the front of each side panel (79, 81) a shortened runner (89) (FIGS. 6 and 12) is mounted parallel to and spaced below the front portion of front runner (83) for a purpose described hereinafter.

The rear panel (82) is used to mount the helices (91, 92) and divider rails (93), and are provided with upper and lower horizontally and diammetrically spaced pairs (94, 96) of bolt hole openings having predetermined locations between horizontally and laterally spaced slots (97) formed therein for receiving the divider rails (93). Each divider rail (93) (FIG. 6) extends the length of the base (74), is relatively flat and has a hook portion (98) at the rear thereof for insertion into a respective slot (97); and is provided further with depending lugs (99), (101) for insertion into a pair of longitudinally aligned and spaced slots (102, 103) formed therefor in the base (74). A flange (104), interrupted by the rear lug (99), is formed at right angles with the remainder of the divider rail (93) for stability when attached to the shelf rear panel (82) and base (74).

The rear panel (82) is completed by the provision of horizontally spaced, alternately staggered oval and circular openings (105, 106), respectively, formed therein for receiving the drive shafts (107) (FIGS. 6 and 8) of a drive motor unit (108). The openings (105, 106) are also each spaced appropriately between adjacent rear panel divider rail slots (97) (FIG. 7) for ensuring the centered mounting of a helix (91, 92), regardless of its size, or between a slot (97) and an adjacent side panel (79) or (81).

Each drive motor unit (108) is of conventional construction having a housing (109) which is secured to the rear panel by fasteners (111) inserted through appropriate one of the pairs of holes (94, 96) provided therefore and such that the drive shaft (107) extends through one of the openings (105) or (106) as determined by the operator. Each drive shaft (107) is connected to a helix (91) or (92) by a pin (112) (FIG. 8) inserted through aligned holes in the shaft (107) and a sleeve (113) of a disc (114) slidably mounted on the shaft (107) and having the innermost coil (115) of a helix (91) or (92) secured thereto.

Figure 7:
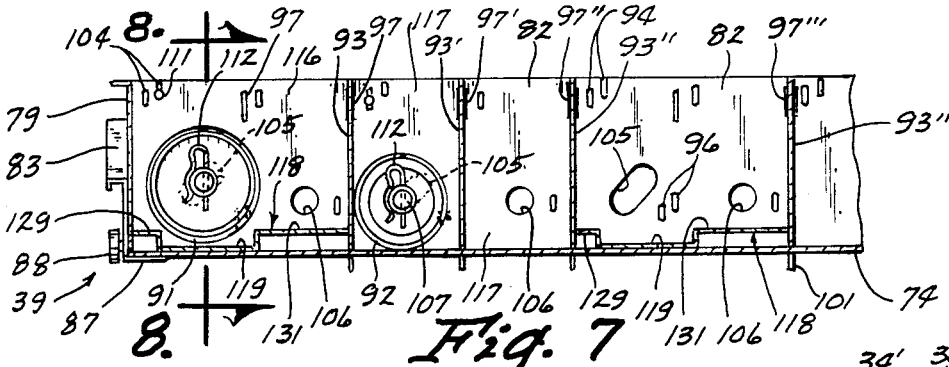
FIG. 7 is an elevational cross-sectional view taken along the line 7—7 in FIG. 4.
Figure 8:
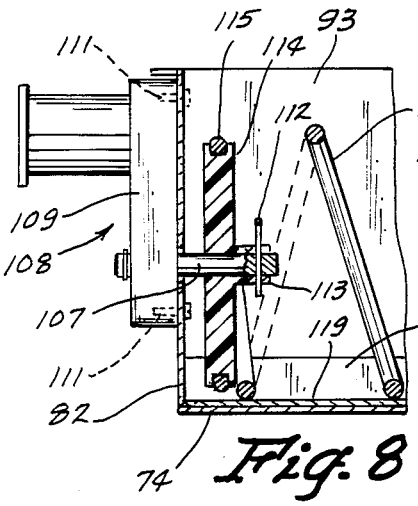
FIG. 8 is an enlarged, elevational cross sectional view as taken along the line 8—8 of FIG. 7.

Referring to FIGS. 4 and 7, it may clearly be seen that a large helix (91) may be secured to the drive shaft (107) extended through an oval opening (105), with a smaller-in-diameter helix (92) secured not in the next adjacent circular opening (106), but in the following next adjacent oval opening (105'). Thus, by inserting a divider rail (93) in slot (97), the second slot (97) to the right of the left side panel (79) (FIG. 7), and with a divider rail (93') in the next adjacent slot (97'), the larger helix (91) extends forwardly from the rear panel (82) within a trough (116) which is twice the width of the adjacent trough (117) within which the smaller helix (92) extends.

The operator has inserted another divider rail (93'') in the next adjacent slot (97'') (FIG. 7) for a small helix mounting, and has spaced the fourth divider rail (93''') a pair of slots (97) to the right of slot (97'') for a large helix mounting, such that another "one bay" trough (117) is formed along with another "two bay" trough (116'). To prevent the large helix (91) from creeping within its larger trough (108), a subfloor (118) is providing having a depressed portion (119) for cradling the helix (91). The smaller helix (92) rides on the base (74). It can therefore readily be seen that with the aforementioned arrangement of removable divider rails for each shelf (39), a large helical coil (91) can be placed side-by-side with a small helical coil (92), and with each coil rotated by its respective drive motor unit (108) to move products of different sizes, large (121) and small (122), respectively, as shown in FIG. 4 forwardly for dispensing at their outer ends (91*a*) and (92*a*). Furthermore, the operator may provide any arrangement he or she desires of widths of troughs and sizes of helices within the boundaries of shelf size and vertical spacing of shelves (39), and within the boundaries of the drive motor mounting holes (94, 96) and openings (105, 106), although these of course, may be varied and increased as to combinations desired.

Each shelf (39) is provided with a plurality of indicia carrying members (123, 124) (FIG. 6) for identifying each respective trough and the price of the product therein. Member (123) is fastened to the front lip (76) of the base by fasteners (126) passed through holes (127) provided therefor in the lip (76) and into the rear of the member (123). Member (124) has tongue portions (128) integral therewith which are inserted into the channels (129, 131) (FIG. 7) formed in the subfloor (118) by the depression (119). Fasteners (not shown) may be inserted through the bottom of the member (124) and into holes (132) (FIG. 6) provided therefor in the base (74) to fix the member (124), and thus the subfloor (118) to the base (74).

Figure 10:
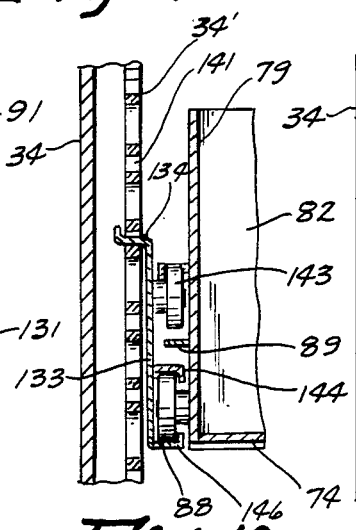
FIG. 10 is an elevational cross-sectional view taken along the line 10—10 in FIG. 9.
Figure 11:
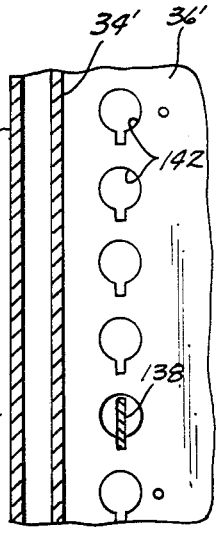
FIG. 11 is an elevational cross-sectional view taken along the line 11—11 in FIG. 9.
Figure 9:
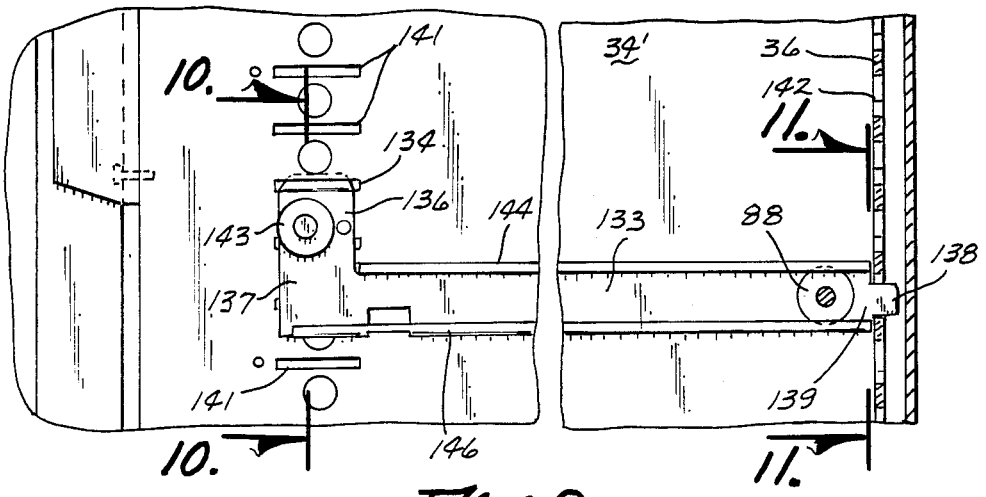
FIG. 9 is an elevational, foreshortened view taken along line 9—9 in FIG. 2.

To cooperate with the runners (83, 84 and 86) on each side of each shelf (39), and to enable the shelf to slide in and out of its inner vending position (FIG. 2) an L-shaped support rail (133) (FIGS. 9 and 10) is provided. Each rail (133) for a shelf (39) has an inwardly extending lug (134) at an upper portion (136) of its front end (137) (FIG. 9), and projection (138) (FIGS. 9 and 11) at its opposite, rear end (139). To accommodate a plurality of vertically adjustable positions of a shelf (39) within the casing (31), vertically spaced slots (141) (FIG. 9) are provided in each opposite wall (34') and (35') for receiving the front lug (134) of each support rail (133) and vertically spaced keyhole openings (142) (FIG. 11) are provided in the rear wall (36') for receiving the projection (138) of the same rail (133) to place the rail (133) in a horizontal disposition as best illustrated in FIG. 9. A roller (143) is mounted on the innerside of each rail upper portion (136) to receive the weight of the shelf via the runners (83, 84 and 86) and the upper and lower edges (144, 146) of each rail are turned inwardly and downwardly as best shown in FIG. 10 to capture the shelf rear roller (88), see FIGS. 9 and 10.

Referring to FIGS. 12 and 13, a shelf (39) is shown in its inner vending and outer loading or servicing positions, respectively. In the inner vending position, the shelf (39) is locked by two actions. First, the support rail roller (143) is nested in an opening (147) (FIG. 6) formed near the front of the runner (83) due to the weight of the shelf (39). Secondly, the door (38) is provided with a shelf closure member (63), rectangular and having a length substantially the full height of the door (38) and with a width greater than the door (38) in order to extend into the casing (31). The member (63) is secured at one end (148) (FIG. 2) to the control panel of the casing (31). As shown in FIG. 2, the member (63) has an inner vertical edge (145) and at least one elongated guide flange (150) secured to the member (63) and adapted to form a Y-shape with the outer edge (145). The member (63) is mounted so as to have some flexibility about its base, and as the door (38) is swung toward a closed position, the member (63) is biased slightly in a counter-clockwise direction, as viewed in FIG. 2, to obviate striking any of the electrical components (43, 48) or the like, by the support (64). The biased position of the member (63) is limited by an element (149) secured to the top inside of the door (38) and in the path of the member (63). Upon further closure of the door (38), the flange (150) strikes the front edge (153) of the inner wall (35'), guiding the member inner edge (145) into engagement with the front end (137) of a shelf rail (133). Thus, the closure member (63) serves to automatically lock and hold all of the shelves (39) in place during vending use of the machine (30), and further functions to block off visible access to the electrical and coin mechanism components of the machine (30) for aesthetic purposes.

To remove the shelf (39), it is lifted slightly upwardly at its front end to disengage the front runner opening (147) from the roller (143) and then is pulled outwardly until the roller (143) is cradled underneath the runners (84 and 86) (FIG. 13). The shelf (39) is then placed in a loading position. To remove the shelf (39) completely, the shelf is lifted upwardly in place to clear the runner (86) from the roller (143) whereupon the rear roller (88) of the shelf (39) may then be rolled completely outwardly of the stationary support rail (133). It will be noted that at all times the shelf roller (88) is rollably locked within the support rail (133) against vertical movement. Thus the support rail (133) functions as a shelf captivating means mounted to the inner sides (34') of the machine (30), which rails (133) are horizontally opposed to each other and which are engaged by the side panels (79, 81) on each shelf (39) and their rollers (88) such that each shelf (39) is held by a pair of said captivating support rails (133) against lateral movement between the vending machine casing walls (34') and (35'). This also provides for maintaining the walls (34' and 35') extremely stable against movement during transportation of the machine (30).

For ease of supplying power to all of the drive motor units (108) on each shelf (39), a male electrical unit (151) (FIGS. 4 and 5) is secured to each shelf (39) which is electrically connected to each unit (108). When each shelf (39) is moved into an inner vending position, the unit (151) engages and is coupled with a female electrical receptacle unit (152) (FIG. 2) secured to the rear inner wall (36') of the casing (31). As a safety measure, when a shelf (39) is moved outwardly to the loading or servicing position of FIG. 13, the electrical components (151) and (152) are separated, thus removing power to the drive units (108) for that particular shelf (39).

Referring now to FIGS. 17–25, a modified embodiment of the tray or shelf (39) of FIGS. 1–16 is shown indicated generally at (39'), and with all like parts of the automatic vending machine (30) of FIGS. 1–16 indicated by like reference numerals.

The shelf (39') is also shown in our companion application entitled "Vending Machine For Table Top or Like", Ser. No. 06/900,181 assigned to a common Assignee.

Figure 18:
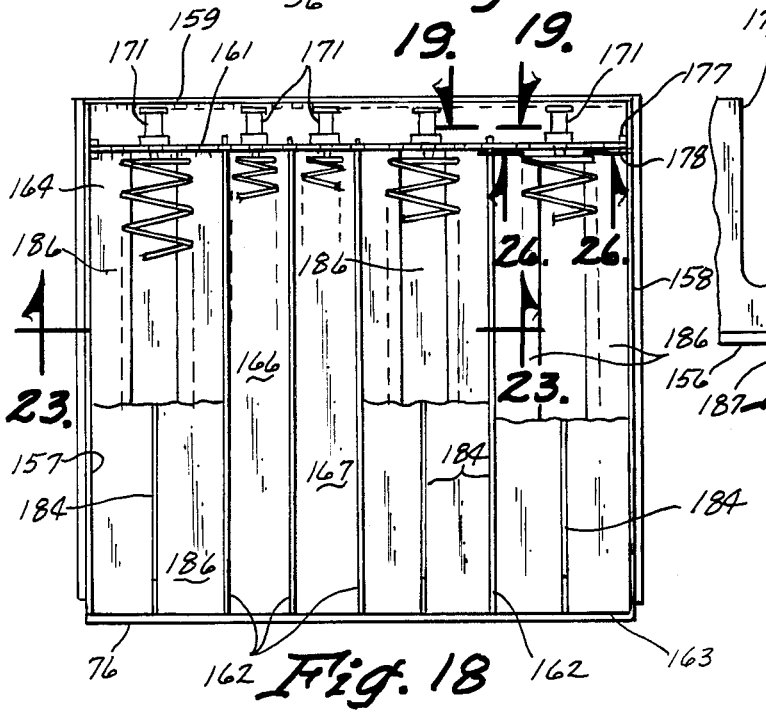
FIG. 18 is a plan view of the modified shelf unit.
Figure 19:
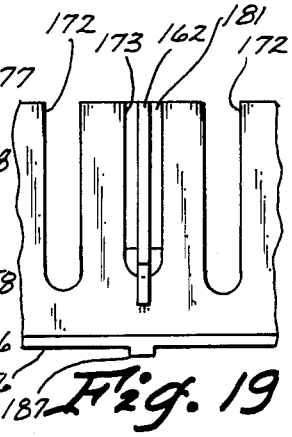
FIG. 19 is an enlarged elevational cross-sectional view taken along the line 19—19 in FIG. 18.
Figure 23:
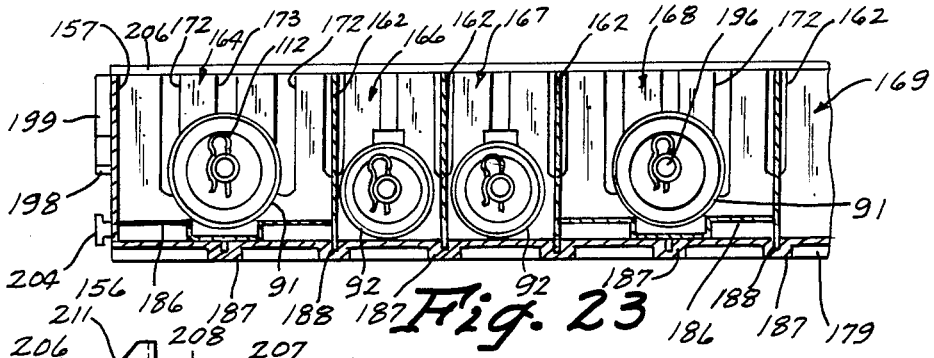
FIG. 23 is an elevational cross-sectional view taken along the line 23—23 in FIG. 18.

Generally, the shelf (39') (FIG. 20) comprises a base (156), upstanding side plates (157, 158), a back plate (159), a rear panel (161) spaced forwardly of and extended laterally parallel of the back plate (159) and a plurality of laterally spaced, longitudinally extended divider members (162) mounted on said base (156) between the side plates (157, 158) to form a plurality of longitudinally extended product feed troughs (164 and/or 166) (FIGS. 18, 23). It will be noted that the troughs (164) are twice the width of the troughs (166); a trough (164) being converted to a pair of smaller troughs (166) by mounting a divider (162) midpoint of the trough (164), and vice versa by removal of a divider (162).

Figure 26:
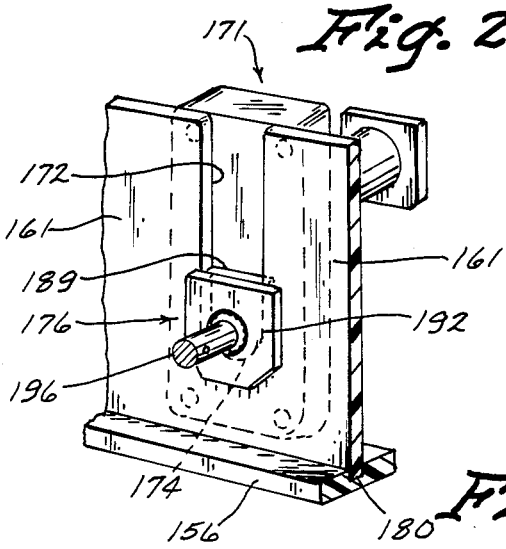
FIG. 26 is an enlarged elevational cross sectional view taken along the line 26—26 in FIG. 18.

To deliver a product to the front edge (163) of the base (156) and then off the base (156) and into the delivery drawer (42), a large helix (91) is provided for the larger troughs (164, 168) disposed longitudinally therein, and the smaller helix (92) is disposed within the smaller troughs (166 and 167). To mount the drive units (171) for the helices (91, 92), the rear panel (161) is uniquely provided with a plurality of vertically formed, horizontally and laterally spaced slots (172, 173) each slot (172, 173) open at its top and closed at the bottom (174) thereof. Each drive unit (171) is provided with a mounting plate unit (176) (FIG. 22) which enables the drive unit (171) to be quickly and easily slid downwardly within a respective slot (172) or (173) to a seated position at the bottom (174) thereof (FIG. 26).

More particularly, the modified and improved tray (39') is of a molded, high density plastic, the base (156), side plates (157, 158) and back plate (159) being an integral single piece. The rear panel (161) (FIG. 20) is removable, slidably mounted within opposed pairs of longitudinally spaced guide strips (177, 178) (FIG. 18) and is mounted in a transverse groove (180) formed across the base (156). Each divider member (162) (FIG. 20) is an elongated, generally rectangular plastic element having a bottom lug (179) near its front end and a T-shaped element (181) formed at the rear end (182) thereof. As shown in FIG. 21, a divider (162) is vertically dropped into a slot (172), for example, with the element (181) placed behind the slot (172) and the bottom (183) of the divider (162) engaging the top surface of the base (156) (FIG. 23). Laterally spaced, elongated slits (184) (FIG. 20) are formed longitudinally of the base (156) within protrusions (187) (FIG. 23) on the underside of the base (156) each slit (184) to receive the bottom edge (188) of a divider (162), and each slit (184) having a slot (185) (FIG. 20) at its front end adapted to receive a divider lug (179) to securely, but removably lock a divider (162) into place on the tray base (156). Due to the capability of a divider (162) to fit into any slot (172 or 173), the width of a trough as determined between a pair of dividers (162) or a divider (162) and one of the side plates (157) or (158) may be varied depending upon the requirements of product size.

Figure 20:
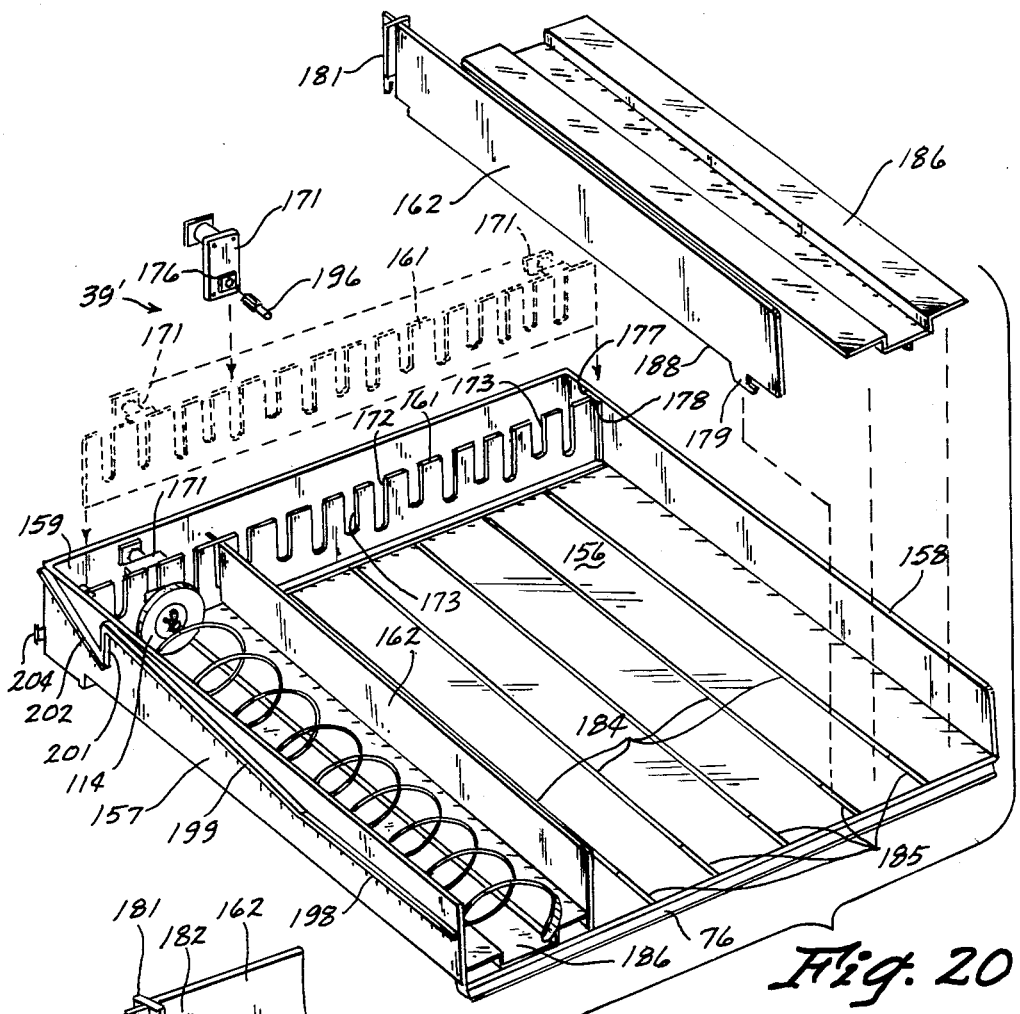
FIG. 20 is a perspective, exploded view of the modified shelf unit.
Figure 21:
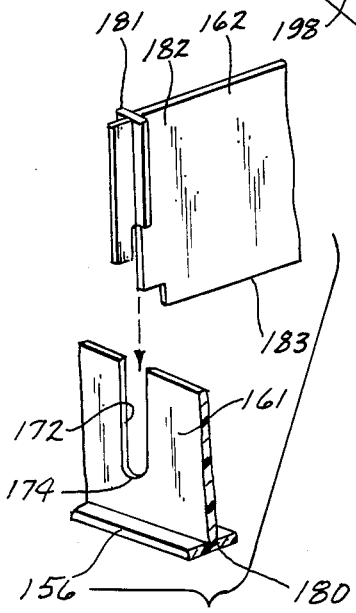
FIG. 21 is an enlarged perspective fragmentary exploded view of portions of the shelf unit.

To accommodate different sized helices (91, 92) and to provide for having the helices (91, 92) at different heights within the troughs (164, etc.), the slots (172, 173) may have different depths (FIG. 20). Further, subfloors (186), a pair in trough (164) and one in trough (168), are provided for supporting the helices and for maintaining their location within a trough. It is readily appreciated that by this arrangement, a variety of trough sizes and helix sizes and placements therein are available within the same tray or shelf (39'). Further, all of the drive units (171) may be mounted on the rear panel (161) prior to its being mounted on the base (156), if desirable.

Figure 6:
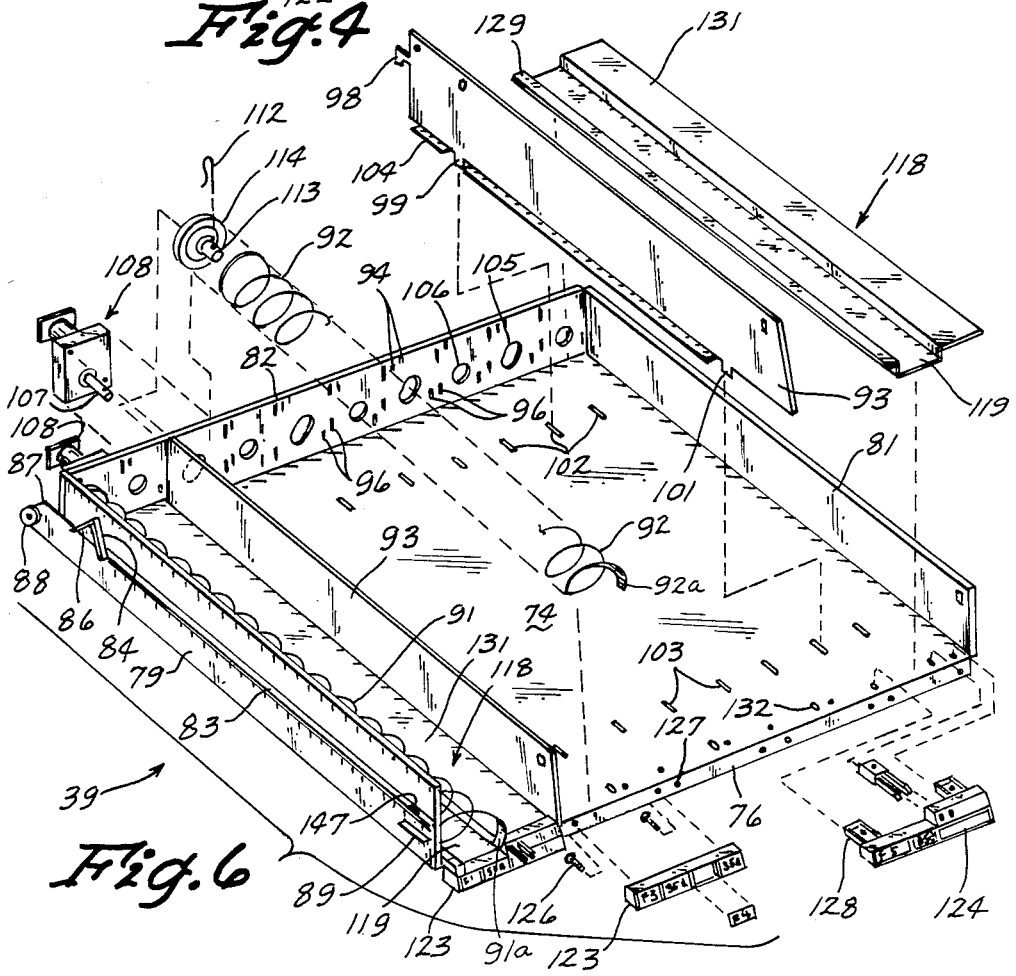
FIG. 6 is a perspective, exploded view of a shelf structure.
Figure 22:
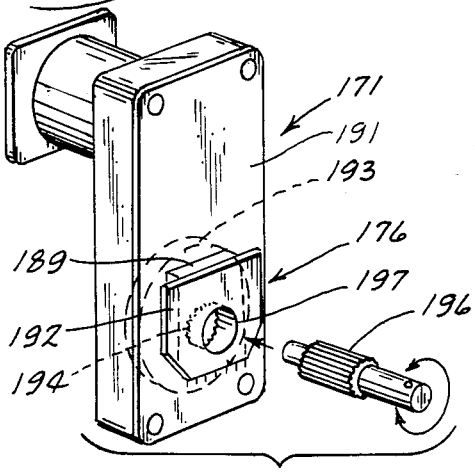
FIG. 22 is an enlarged perspective exploded view of a helix drive unit for the modified shelf unit.

Referring to FIG. 22, a conventional helix drive unit (171) is illustrated, similar to the drive units (108) of FIG. 6 and for the same function, but with several improvements. The mounting plate unit (176) includes a block (189) affixed to the front plate (191) of the unit (171) and with a wider plate (192) secured thereto to form a T-like structure. With the block (189) having a width slightly less than the width of a slot (172 or 173), the plate (192) will engage the areas of the rear panel (161) adjacent either side of a slot, thereby firmly, but readily removably locking the drive unit (171) into the slot. Further, to provide for rotatably adjustable attachment of a helix (91) or (92) to the drive unit (171), the drive gear (193) of the unit (171) has a star-shaped or notched receptacle (194) formed therein to receive a like notched drive shaft (196), a passage (197) therefor formed in the block (189) and plate (192). By this arrangement, the front end (91*a*) (FIG. 20) of a helix (91), for example, may be rotatably positioned at any degree due to the ease of rotatably mating the helix drive shaft (196) within the drive gear receptacle (194).

Figure 24:
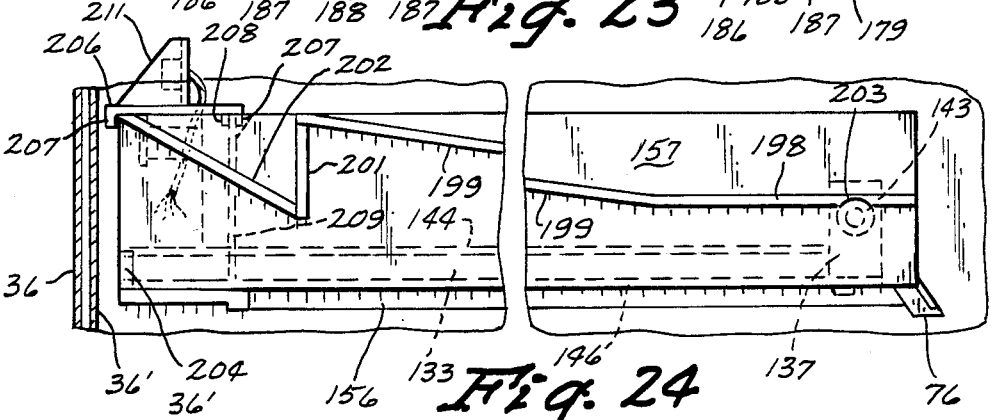
FIG. 24 is a foreshortened, elevational view taken along the line 24—24 in FIG. 17.
Figure 25:
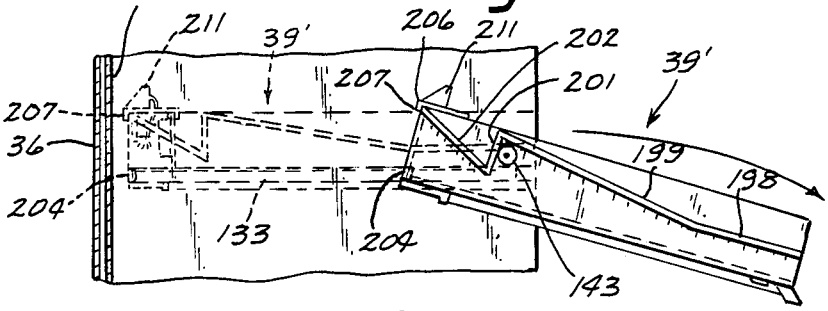
FIG. 25 is an elevational view of the modified shelf unit shown in its extended, loading position.

Referring to FIGS. 24 and 25, the molded shelf (39') includes a shortened front runner (198) secured to either side, each runner arrangement including further a rearwardly and upwardly inclined runner (199), a vertical runner (201) and a sharply upwardly inclined rear runner (202). A curved notch (203) (FIG. 25) is formed in the underside of each front runner (198) near the front end thereof to receive each side support rail roller (143) when the shelf (39') is in the inner vending position (FIG. 24), and as compared to the roller (88) of the first shelf embodiment (39), an outwardly protruding guide lug (204) (FIGS. 23, 25) secured to the lower rear corner of each side of the shelf (39') performs the same function as the roller (88) for the shelf (39'). FIG. 25 shows the relation of the shelf (39') to the side support rails (133), a withdrawal similar to the withdrawal of shelf (39), but with a more gradual lowering of the shelf (39') due to the gradually inclined runner (199).

A cover plate (206) (FIG. 24) may be provided over the rear of the divider members (162) and over the drive units (171), to aid in preventing them from moving upwardly and outwardly of their installed positions, during transportation or unusual movement of the machine (30). The plate (206) has a length equal the width of the shelf (39'), with at least one transversely extended, depending leg (207) at the rear thereof to engage the back plate (159), and with a pair of longitudinally spaced, transversely extended, depending legs (208, 209) at the front thereof to engage the upper edge of the rear panel (161). The plate (206) includes further a mounting bracket (211) at one upper end thereof for supporting the male electrical receptacle (151), which receptacle (151) serves the same function in the same manner as described hereinbefore.

As best illustrated in FIG. 23, the placement of each helix drive unit (171) within a slot (172, 173) is free and unrestricted with respect to up and down movement, particularly if all slots are long (172), and as limited only by the depth of the slot and by the cover plate (206). This is due to the location of the drive unit (171) being determined by the diameter of the respective helix (91) or (92) and its engagement with the tray base (156) or with a subfloor (186). Thus the drive units (171) float to a certain extent within the slots (172, 173) of this embodiment, their respective helices (91 or 92) being relatively vertically unrestricted as they ride upon the tray base (156) or a subfloor (186).

Of further import, like the shelf units (39) of the first embodiment (FIGS. 1–16), this embodiment also has the capability of a single trough (164) (FIG. 23) utilizing either a single large helix (91) or a pair of smaller drive helices (92), due to the provision of the three slots (172), (173), (172) formed at the rear of the trough (164). This arrangement is readily accomplished by the operator by merely rearranging large and small combined drive motor - helix units within the slots, changing a subfloor (186) if necessary. More particularly, the same width trough (164) with its three slots (172), (173), (172) can use either a large helix (91) mounted in the center slot (173), or a pair of smaller helices (92) each mounted in a side slot (172), all helices (91, 92) using the same drive unit (171). However, the center drive unit (171) with its off-center drive shaft (196) is reversed from the positions shown in FIGS. 22 and 26 where the drive shaft (196) is at a lower position for connection to a smaller helix (92). Thus, by merely rotating the drive unit (171) one hundred eighty degrees (180°), the driving location of the drive shaft (196) is changed to a higher position and connection to a larger helix (91) is thereby readily accomplished. Thus, this unique reversibility of the drive units (171) and the provision of the slots (172), (173) enables the same drive unit (171) to be used in a same slot (172) for example for driving connection to either a large helix (91) or a small helix (92) without modifying the helices (91, 92) or the type of driving connection, i.e., a cotter pin (112).

Again similar to the shelf unit (39), the unit (39') has the capability of vending items of a width greater than those normally vended, due to the removability of one or more of the divider members (162) and (93). As an example, were all divider members removed, and with helices (91) placed adjacent each side panel of the shelf, and with one of the drive motor units (108) or (171) reversed so as to rotate the helices in opposite directions tending to move them away from each other, a product having a width substantially that of each shelf (39), (39') could readily be vended.

While the invention has been described with reference to a particular embodiment, and one alternative thereof, other changes or modifications may be suggested to those skilled in the art without departing from the inventive concept or scope of the appended claims.

We claim:

1. For use in a vending machine having a frame, an improved shelf arrangement comprising:

at least one shelf means adapted to be movably mounted within the frame for movement between a vending position and a service position;

a first helical coil means mounted on said shelf means and adapted to receive first items of merchandise between the convolutions thereof for axial advance responsive to rotation of said first coil means for dispensing at one end thereof;

a second helical coil means mounted on said shelf means and adapted to receive second items of merchandise between the convolutions thereof for axial advance responsive to rotation of said second coil means for dispensing at one end thereof, said second coil means disposed on said shelf means adjacent said first coil means and movable freely vertically thereon wherein said second items have a size different from the size of said first items;

panel means mounted on said shelf means, said panel means including an elongated panel extending transversely of said shelf means and having a plurality of horizontally spaced, vertically disposed slots formed therein which are open at the top and closed at the bottom thereof, one or more said helical coil means slidably mounted in one or more said slots, respectively, whereby each said mounted helical coil means is permitted vertical movement within each said slot within which it is mounted;

divider means secured to said shelf means intermediate said first and second coil means whereby to maintain separate the respective items of merchandise being vended by each coil means; and means for causing rotation of each said coil means responsive to customer selection.

2. In combination with the invention of claim 1 and further wherein the vending machine has a swingable door for movement from an open position exposing the interior of the machine to a closed position for normal vending purposes, the door having a shelf means retaining unit secured thereto for engaging each shelf means when the door is closed, thereby holding the said engaged shelf means in an immovable condition, and further wherein said retaining unit includes a flexible member secured to the front door, and including further a guiding member engageable with the vending machine frame for guiding the flexible member into engagement with said shelf means.

3. For use in a vending machine, an improved shelf arrangement comprising:

a tray having a base, a rear panel, and divider members mounted on said base in parallel laterally spaced relationship to form longitudinally disposed product feed troughs over said base;

a helix disposed longitudinally within a feed trough;

said rear panel having a plurality of vertically disposed, horizontally spaced slots formed therein, each slot open at the top and closed at the bottom of the rear panel; and a drive unit for driving connection to a helix, said drive unit removably, slidably mounted into any one of said slots.

4. The invention of claim 3 and further wherein a plurality of said slots are formed in said rear panel for each feed trough, whereby helices of varying size may be placed in different feed troughs, respectively, on the same tray, each helix connected to a respective drive unit.

5. The invention of claim 3 and further wherein said rear panel is removably secured to said base, whereby said drive units are mountable to said rear panel prior to the securement of said rear panel to said base.

6. The invention of claim 3 and further wherein a said drive unit and a said helix connected as a unit are slidable upwardly and downwardly for removable mounting within one of said slots.

7. The invention of claim 6 and further wherein a said combined drive unit and helix is mounted unrestricted within a said slot as determined by the diameter of the said helix.

8. The invention of claim 3 and further wherein a plurality of said slots are formed in said rear panel for each feed trough, whereby either a single helix of one size or a pair of same size helices of a size smaller from said single helix may be placed alternatively in said single feed trough, each helix operably connected to a respective drive unit and with each drive unit removably, slidably inserted into one of said plurality of slots.

9. The invention of claim 3 and further wherein said tray has a back plate spaced rearwardly from said rear panel, with said divider members removably connected to said rear panel and extended forwardly therefrom whereby an unrestricted space is formed between said rear panel and said back plate.

* * * * *